US007204045B2

(12) United States Patent
Lee

(10) Patent No.: US 7,204,045 B2
(45) Date of Patent: Apr. 17, 2007

(54) SHOE HAVING LIGHT EMITTING FUNCTION

(76) Inventor: Ching-Hui Lee, No. 13, Kangtzuwei, Madou Township, Tainan County (TW)

( * ) Notice: Subject to any disclaimer, the term of this patent is extended or adjusted under 35 U.S.C. 154(b) by 158 days.

(21) Appl. No.: 11/052,937

(22) Filed: Feb. 9, 2005

(65) Prior Publication Data

US 2006/0174521 A1 Aug. 10, 2006

(51) Int. Cl.
*A43B 23/00* (2006.01)

(52) U.S. Cl. ..... 36/137

(58) Field of Classification Search ..... 36/137; 362/103

See application file for complete search history.

(56) References Cited

U.S. PATENT DOCUMENTS 2,931,893 A * 4/1960 Quijano et al. ..... 36/1
3,800,133 A * 3/1974 Duval ..... 362/103
4,128,861 A * 12/1978 Pelengaris ..... 362/103
4,158,922 A * 6/1979 Dana, III ..... 36/137
5,381,615 A * 1/1995 MacMillan ..... 36/137
5,406,724 A * 4/1995 Lin ..... 36/137
5,490,338 A * 2/1996 Hwang et al. ..... 36/137
5,599,088 A * 2/1997 Chien ..... 362/103
5,860,727 A * 1/1999 Chien ..... 362/84
2003/0145494 A1* 8/2003 Hsu ..... 36/137
2004/0103563 A1* 6/2004 Linge ..... 36/137
2006/0133067 A1* 6/2006 Tsai ..... 362/103

* cited by examiner

*Primary Examiner*—Ted Kavanaugh
(74) *Attorney, Agent, or Firm*—Rosenberg, Klein & Lee

(57) ABSTRACT

A shoe includes a translucent sole, a translucent heel, a shoe body on top of the sole; and a light emitting device; the light emitting device includes a power source held in the heel, several light emitting elements held in the heel and between the sole and the shoe body, and secured on an outer side of the shoe body, a switch electrically connected to the power source and the light emitting elements such that the shoe will shine when the light emitting elements are powered.

10 Claims, 8 Drawing Sheets

SHOE HAVING LIGHT EMITTING FUNCTION

BACKGROUND OF THE INVENTION

1. Field of the Invention

The present invention relates to a shoe having light emitting function, more particularly one, which are equipped with light emitting elements so as to shine when the wearer walks, runs or dances.

2. Brief Description of the Prior Art

The major functions of shoes are to protect the wearers' feet, to keep the feet warm and comfortable, and to match the clothing and make the wearers look more attractive. Many types of shoes are available for serving their respective purposes. And, there is always a great demand for shoes of new designs, and there are people who like to buy and use fancy and multi-functional articles.

SUMMARY OF THE INVENTION

It is a main object of the invention to provide a shoe having light emitting function so that consumers have additional choices.

The shoe of the invention includes a translucent sole, a translucent heel, a shoe body on top of the sole; and a light emitting device. The light emitting device includes a power source held in the heel, several light emitting elements, which are respectively held in the heel, and held in grooves on an upper side of the sole, and secured on an outer side of the shoe body. The light emitting device further has a switch electrically connected to the power source and the light emitting elements. Thus, the shoe will shine when the light emitting elements are powered.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
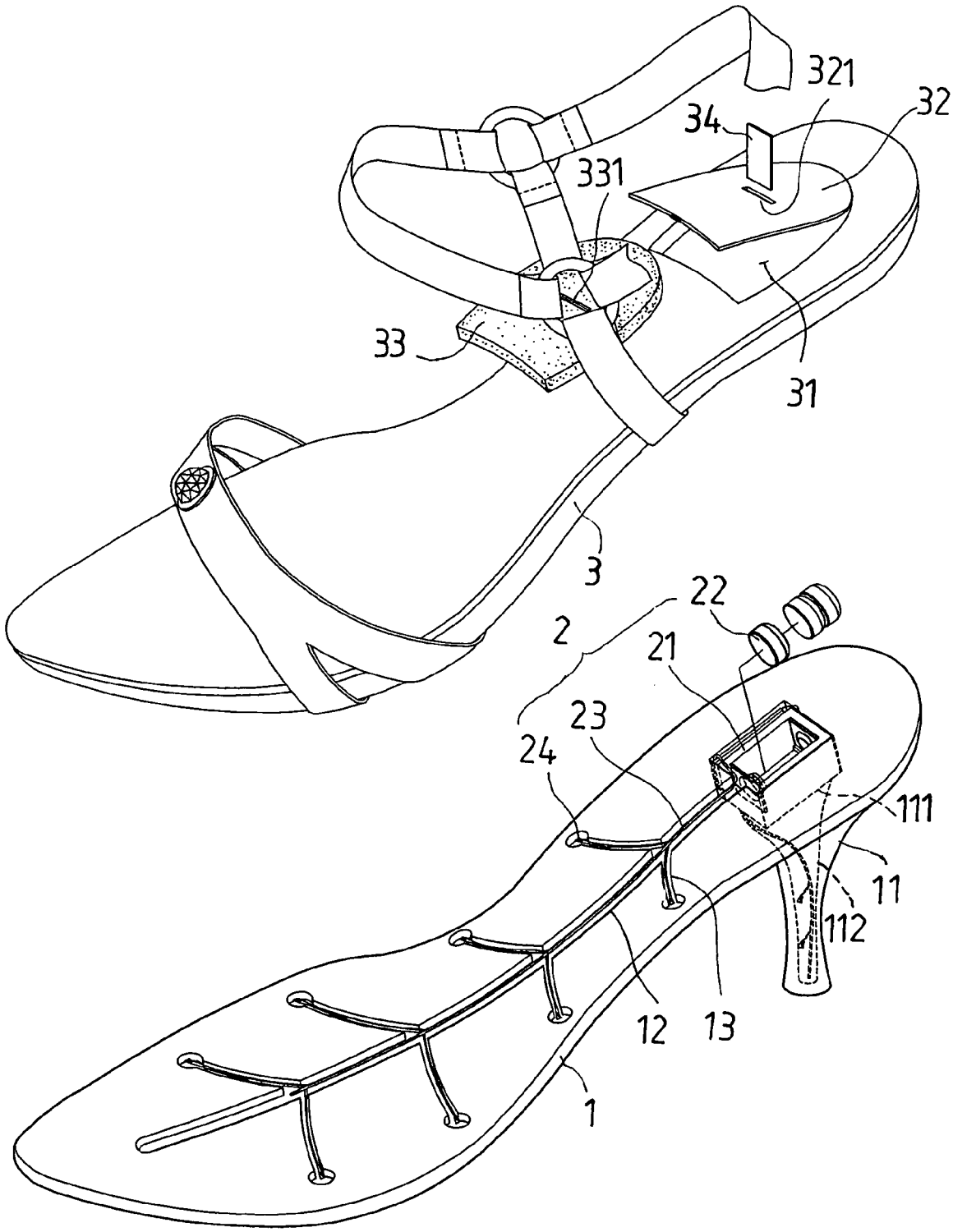
FIG. 1 is an exploded view of the first embodiment of a shoe having light emitting function in the present invention.

Referring to FIG. 1, a first preferred embodiment of a shoe having light emitting function includes a sole 1, a light emitting device 2, and a shoe body 3.

The sole 1 is joined to a heel 11 at a rear end portion thereof. Both the sole 1 and the heel 11 are preferably transparent, and they have to be at least translucent. The heel 11 has a holding room 111 therein. And, the sole 1 has a through hole right above the holding room 111 of the heel 11. The heel 11 has a holding tunnel 112 under and communicating with the holding room 111. Furthermore, the sole 1 has a lengthways-extending holding groove 12 on the upper side thereof, which holding groove 12 communicates with the holding room 111 of the heel 11, and the sole 1 has several locating grooves 13 on the upper side thereof, which extend sideways from the holding groove 12.

Figure 2:
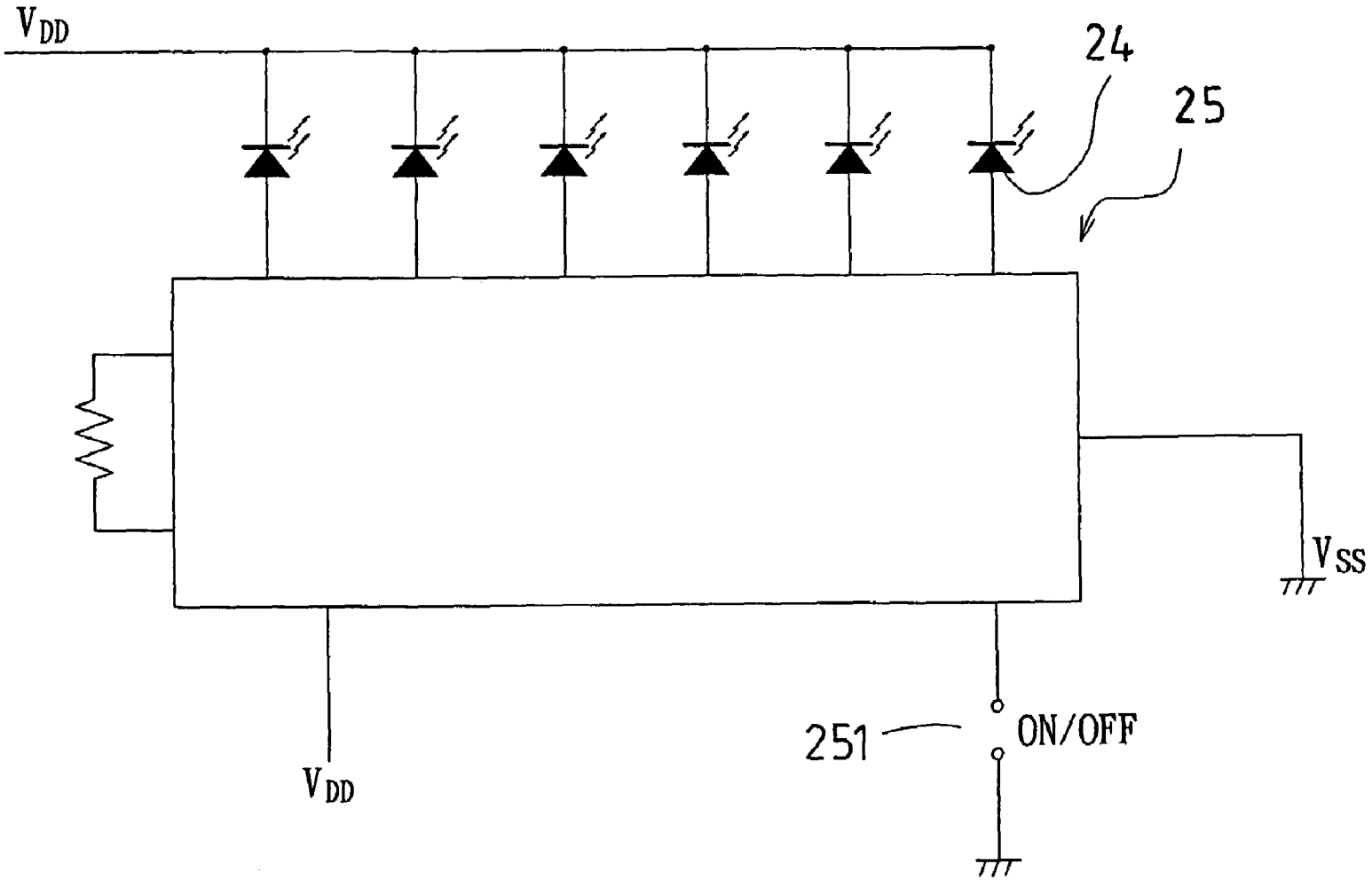
FIG. 2 is the circuit diagram according to the present invention (1)
Figure 3:
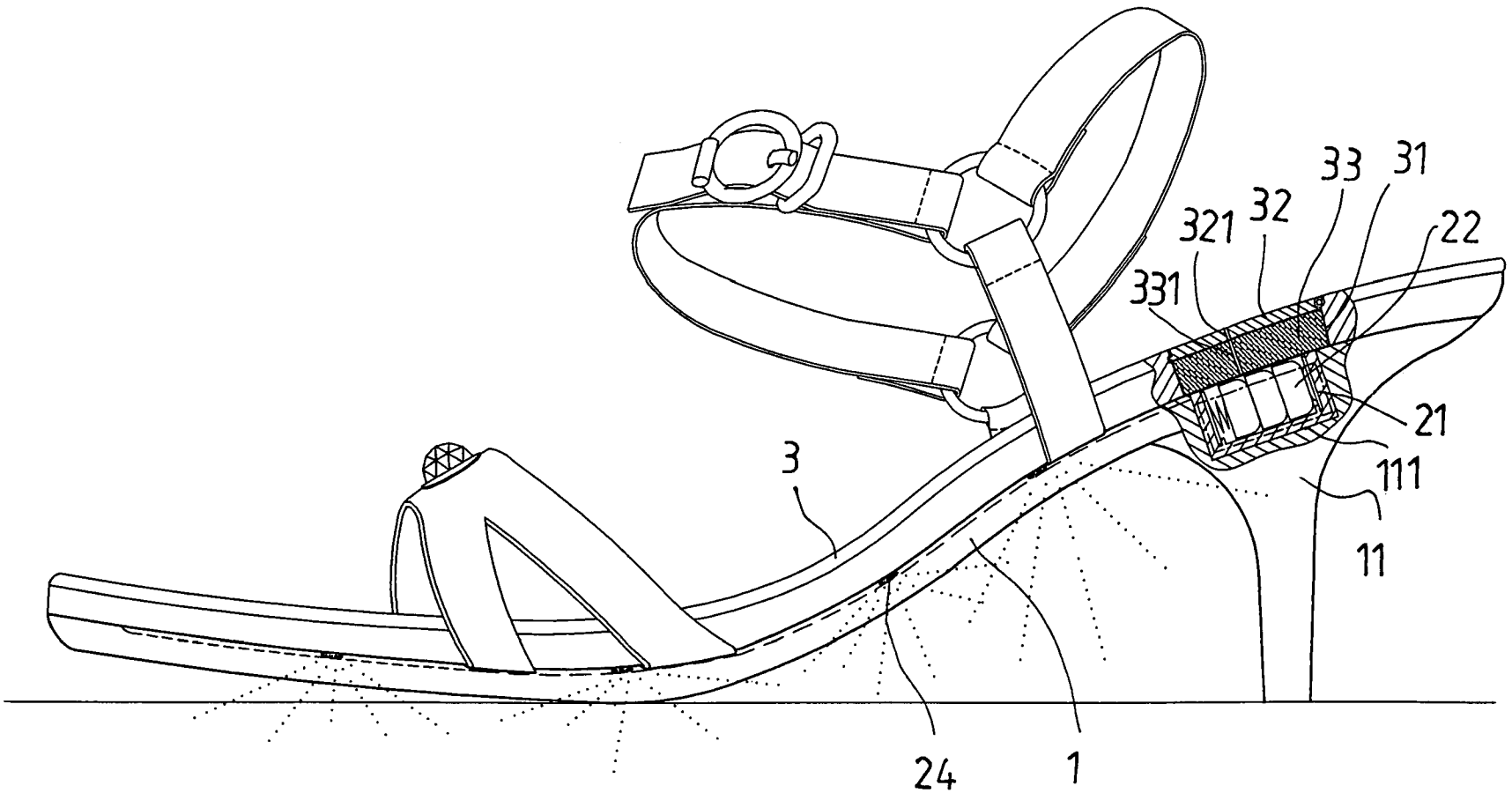
FIG. 3 is a view of the present invention with the light emitting elements shining.
Figure 4:
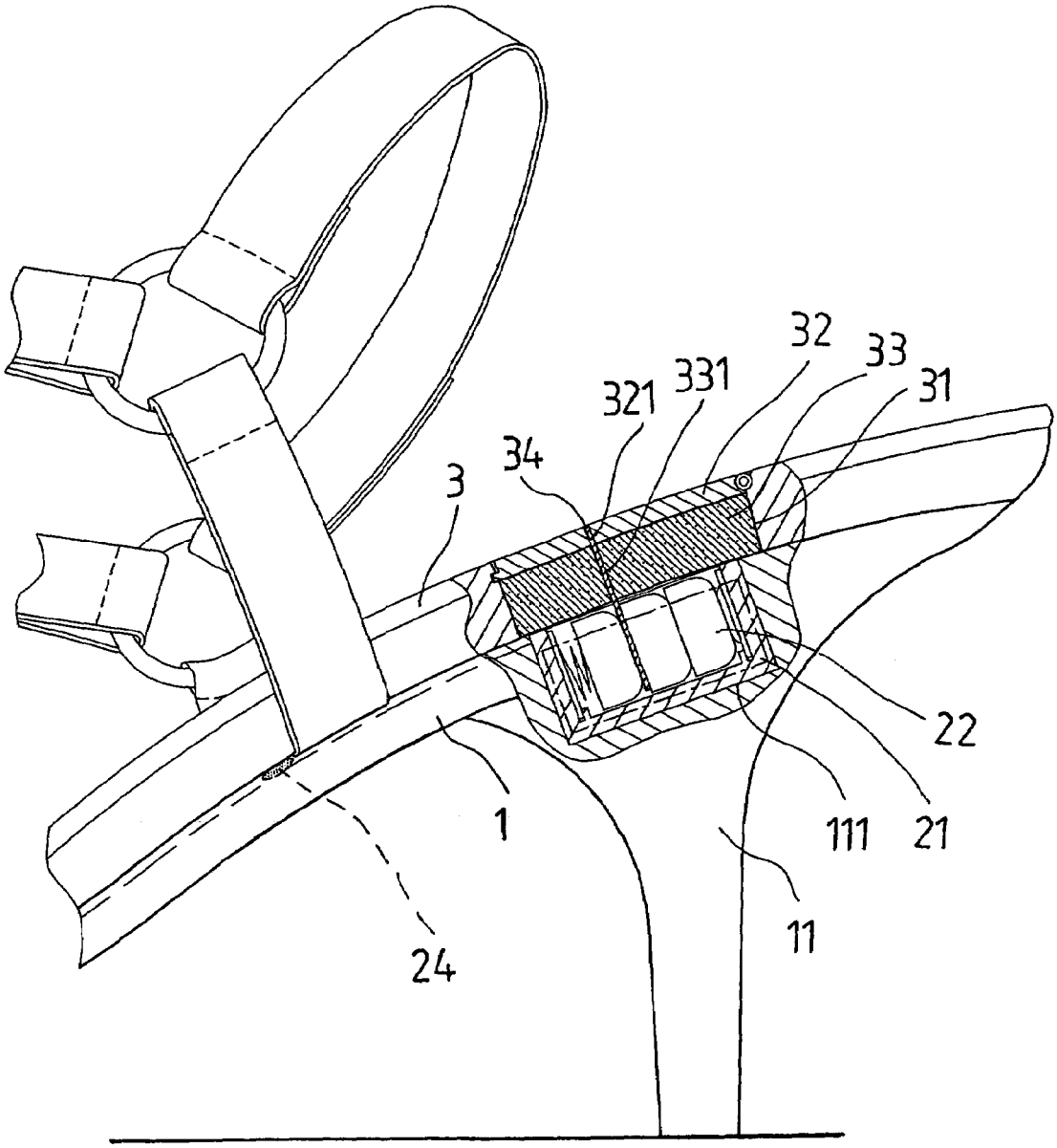
FIG. 4 is a partial view of the invention with the power supply to the light emitting elements being cut off by means of the insulating plate.

The light emitting device 2 includes a battery holder 21, several batteries 22 held in the battery holder 21, cords 23, several light emitting elements 24 such as light emitting diodes, and a control circuit 25 (FIG. 2). The light emitting elements 24 are connected to the cords 23. The control circuit 25 includes a control IC, resistors, and a switch 251, and the control circuit 25 is electrically connected to the batteries 22 and the cords 23 for controlling the light emitting elements 24; the switch 251 is used for switching the control circuit 25 on, and for switching the control circuit 25 off, and it can be a vibration switch or a sliding switch.

The shoe body 3 has a through hole 31 on a rear end portion thereof, a covering part 32 for the through hole 31, and a pressing member 33 fitted in the through hole 31. The covering part 32 has an aperture 321 while the pressing member 33 has an aperture 331. The apertures 321 and 331 will face each other, and form a passage when the pressing member 33 is fitted in position, and when the covering part 32 is closed. And, an insulating plate 34 is used for cutting off the power supply to the light emitting elements 24, plus for preventing electricity leakage, which insulating plate 34 will disconnect the batteries 22 of the light emitting device 2 when passed through the apertures 321 and 331 of the covering part 32 and the pressing member 33, and passed between two adjacent ones of the batteries 32.

In assembly, the battery holder 21 is positioned in the holding room 111 of the heel 11, and the cords 23 are positioned in the holding groove 12 of the sole 1 and the holding tunnel 112 of the heel 11, and the light emitting elements 24 are respectively positioned in the locating grooves 13 of the sole 1 and the holding tunnel 112 of the heel 11. Then, the holding groove 12 and the locating grooves 13 are filled with glue so that the cords 23 and the light emitting elements 24 are fixed. And, the shoe body 3 is joined to the sole 1 with the pressing member 33 thereof being pressed against and fixing the batteries 22 held in the holding room 111 of the heel 11. Therefore, the user is allowed to change batteries after the covering part 32 of the shoe body 3 is opened, and the pressing member 33 removed.

Thus, the control circuit 25 will be switched on, and make the light emitting elements 24 emit light in a certain manner, e.g. to keep shining, and to flash repeatedly, when the wearer of the shoe is walking, running or dancing.

Figure 5:
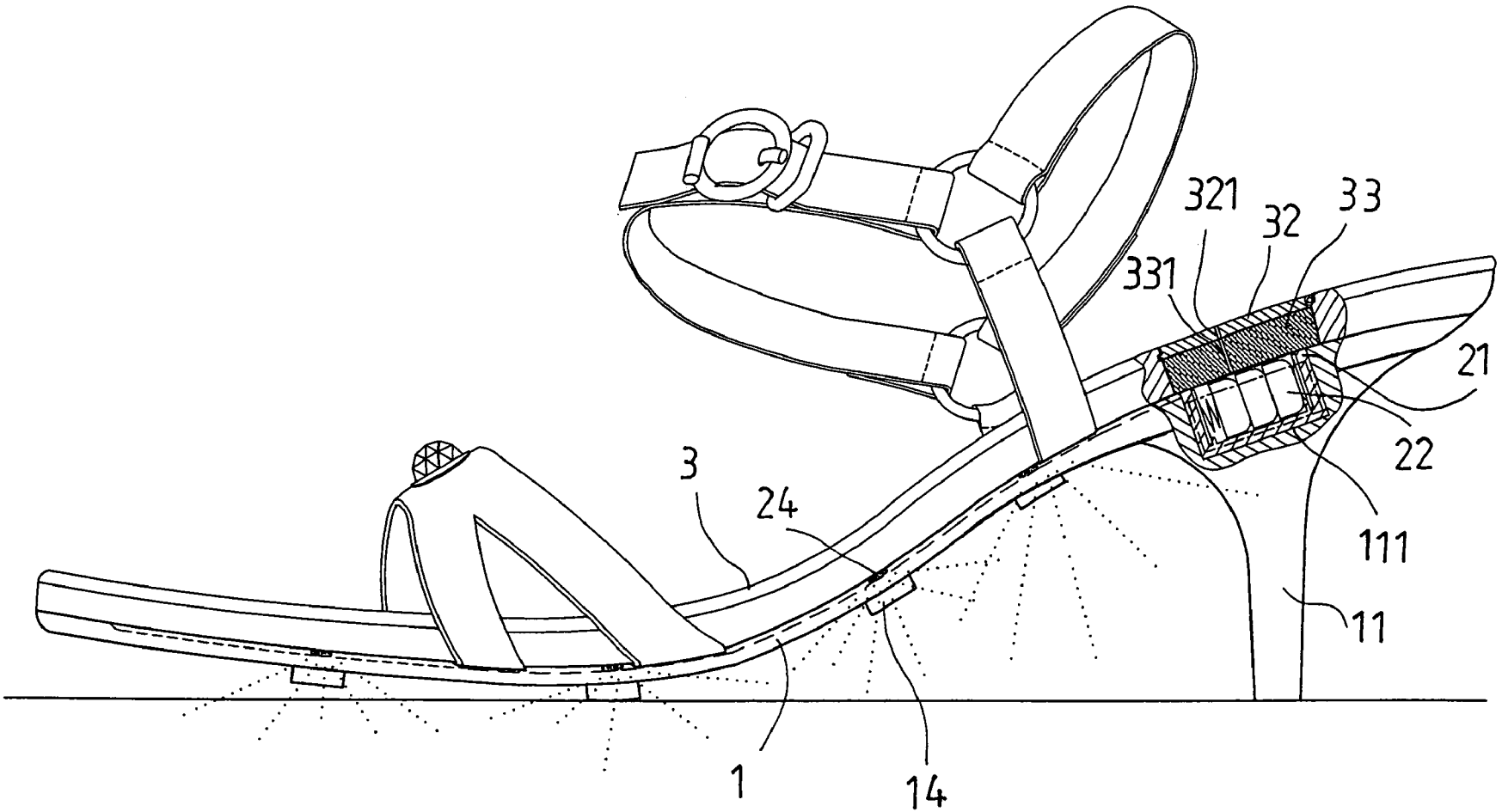
FIG. 5 is a view of the second embodiment with the light emitting elements shining.

Because the sole 1 will become thinner gradually through use, the cords 23 and the light emitting elements 24 in the grooves 12 and 13 will be exposed to outside and left unprotected after the shoe is used for a certain length of time. Referring to FIG. 5, the sole 1 is formed with strengthening protrusions 14 on the lower side thereof, which are right under the holding groove 12 and the locating grooves 13; thus, the cords 23 and the light emitting elements 24 won't be exposed to outside even after the shoe is used for a long time.

Figure 6:
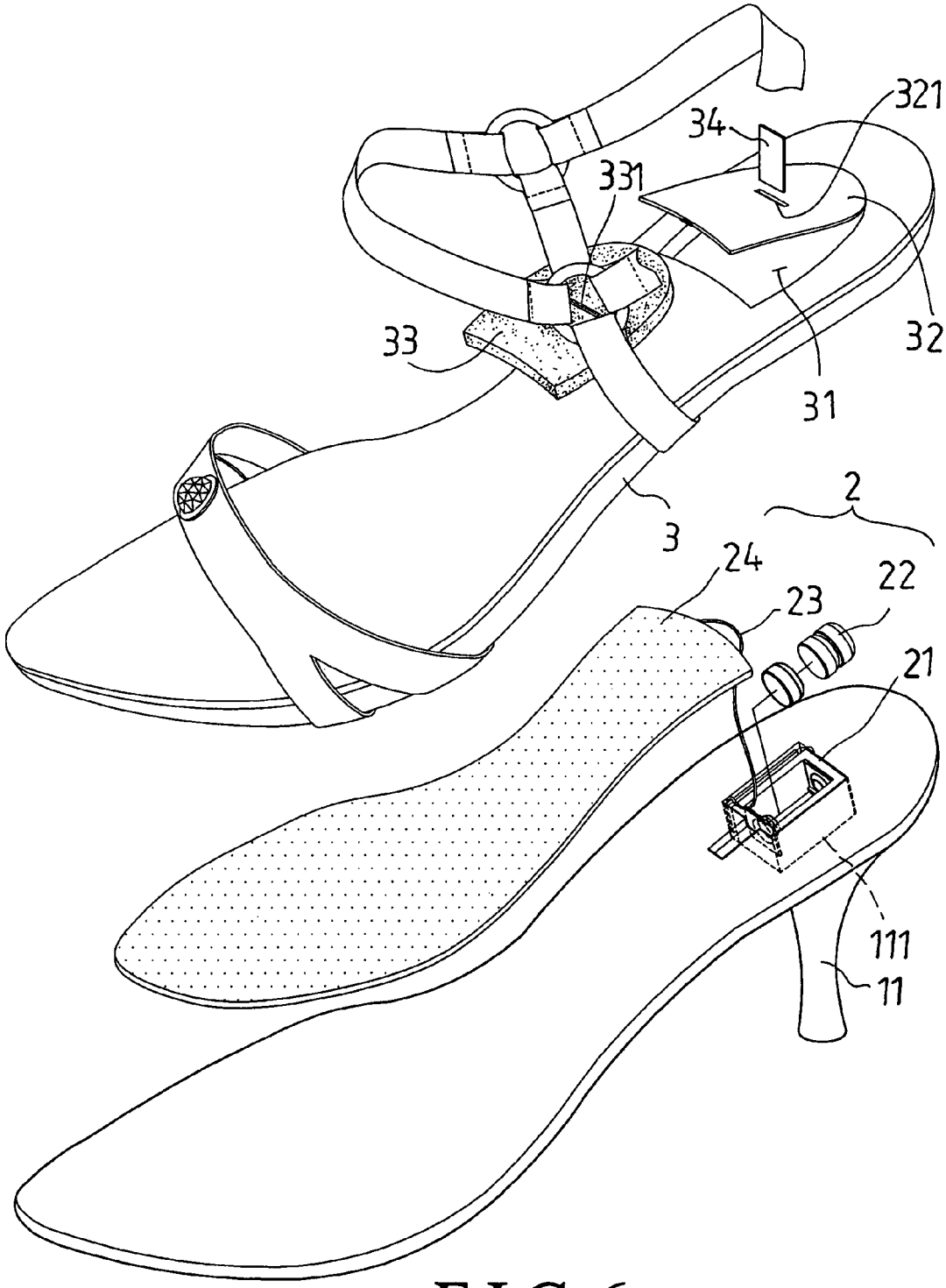
FIG. 6 is a view of the third embodiment with the light emitting elements shining.
Figure 7:
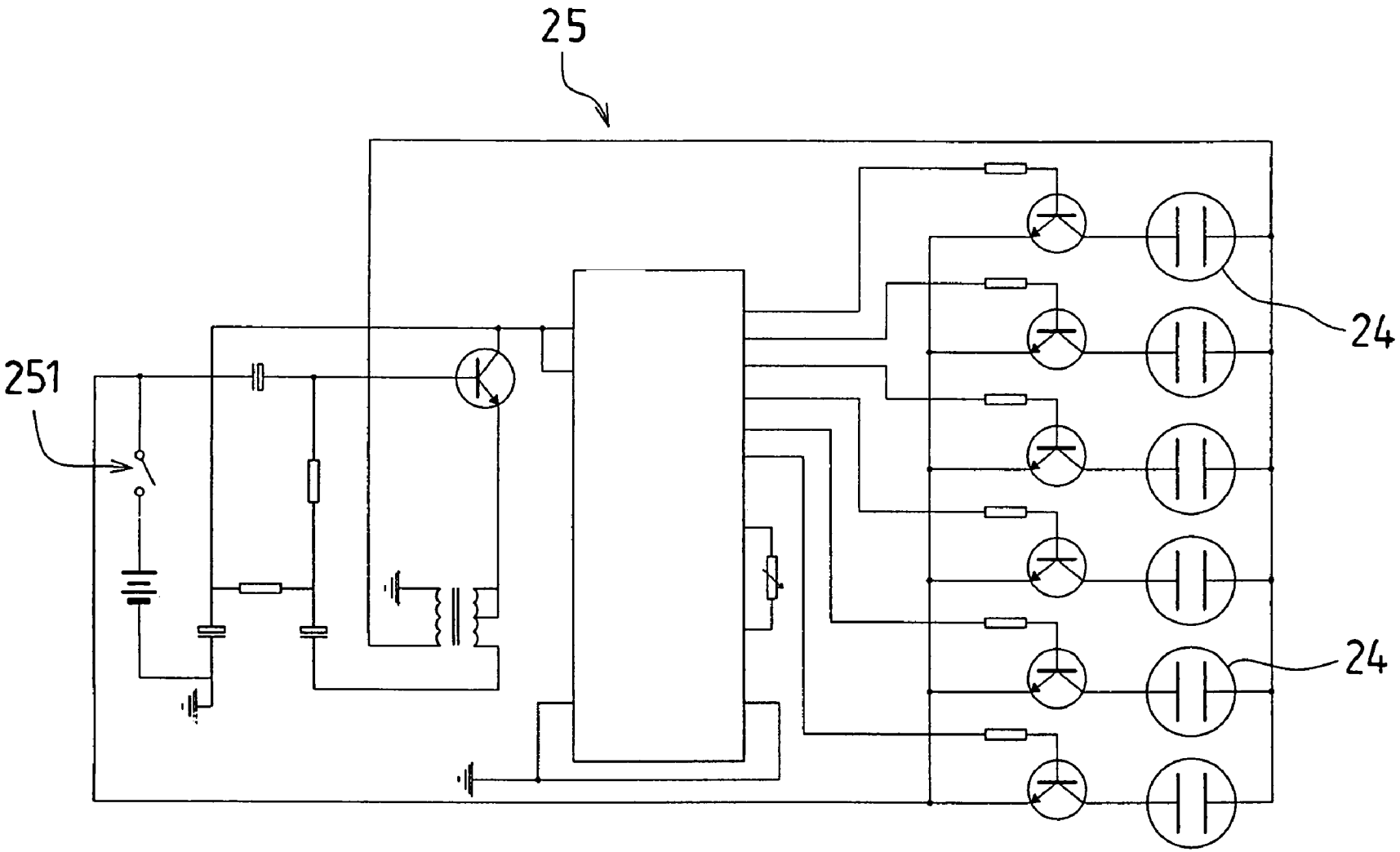
FIG. 7 is the circuit diagram according to the invention (2)

Referring to FIGS. 6 and 7, alternatively, the light emitting device 2 is equipped with an EL plate 24 used for producing light, which is stuck on an upper side of the sole 1, and connected to the cords 23; thus, the shoe will shine when the EL plate 24 is powered.

Figure 8:
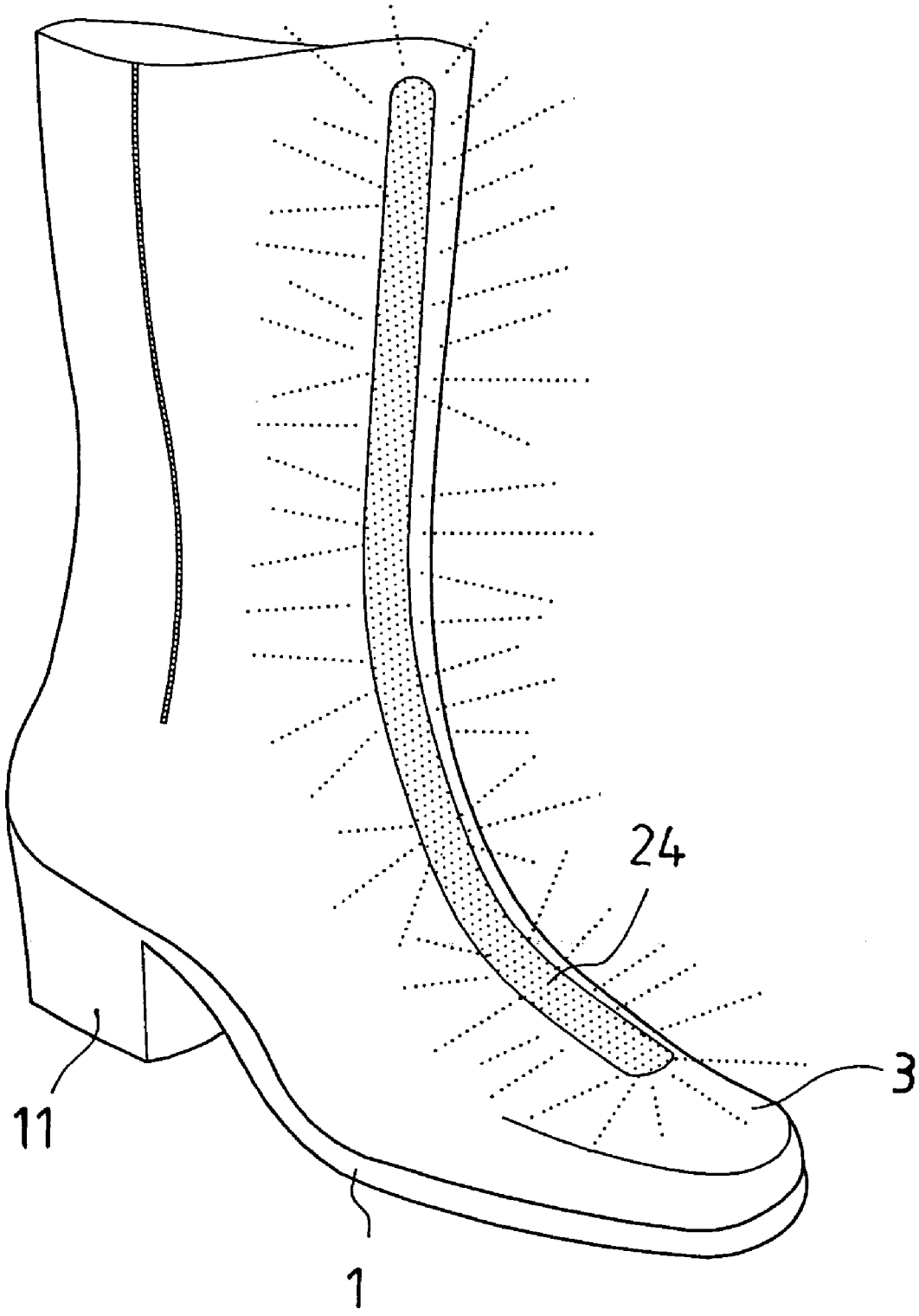
FIG. 8 is a view of the fourth embodiment with the light emitting elements shining.

Referring to FIG. 8, alternatively, the light emitting device 2 is equipped with an EL sheet 24 used for producing light, which is stuck on an outer side of the shoe body 3, and connected to the cords 23; thus, the shoe will shine when the EL sheet 24 is powered.

From the above description, it can be easily understood that the shoe of the present invention will shine to look more attractive while serving it major functions, and consumers have additional choices.

What is claimed is:

1. A shoe having light emitting function, comprising a sole; the sole being at least translucent; a heel joined to a rear end portion of the sole; the heel being at least translucent; a shoe body joined to the sole; and a light emitting device; the heel having a holding room therein; the sole having a through hole right above the holding room of the heel; the sole having a lengthways-extending holding groove on an upper side thereof; the holding groove of the sole communicating with the holding room of the heel; the sole having a plurality of locating grooves extending sideways from the holding groove on the upper side thereof; the shoe body having a through hole right above the through hole of the sole; the shoe body having a covering part used for covering the through hole thereof; the light emitting device including: (a) a battery bolder held in the holding room of the heel; (b) a plurality of batteries held in the battery holder; (c) cords held in the holding groove of the sole; (d) a plurality of light emitting elements held in the locating grooves of the sole and connected to the cords; and (e) a control circuit electrically connected to the batteries and the cords for controlling the light emitting elements; the control circuit having a switch used for switching the control circuit on, and for switching the control circuit off.

2. The shoe having light emitting function as claimed in claim 1, wherein the sole and the heel are transparent.

3. The shoe having light emitting function as claimed in claim 1, wherein the holding groove and the locating grooves of the sole are filled with glue so that the cords and the light emitting elements are fixed.

4. The shoe having light emitting function as claimed in claim 1, wherein a plurality of covers are fitted on the holding groove and the locating grooves of the sole to fix the cords and the light emitting elements.

5. The shoe having light emitting function as claimed in claim 1, wherein the light emitting elements are light emitting diodes.

6. The shoe having light emitting function as claimed in claim 1, wherein a lower side of the sole has a plurality of strengthening protrusions right under the holding groove and the locating grooves.

7. The shoe having light emitting function as claimed in claim 1, wherein the switch of the control circuit is a vibration one.

8. The shoe having light emitting function as claimed in claim 1, wherein the switch of the control circuit is a sliding one.

9. The shoe having light emitting function as claimed in claim 1, wherein the covering part for the through hole of the shoe body has an aperture thereon, and an insulating plate is passed through the aperture of the covering part and passed between two adjacent ones of the batteries in a removable manner for disconnecting the batteries and for preventing electricity leakage.

10. The shoe having light emitting function as claimed in claim 1, wherein the heel has a holding tunnel under and communicating with the holding room thereof, and other light emitting elements and cords of the light emitting device are held in the holding tunnel of the heel.

* * * * *